United States Patent [19]

Campbell

[11] 4,177,986

[45] Dec. 11, 1979

[54] COIN DROP GAME

[76] Inventor: Gene E. Campbell, 327 Stepney St., Inglewood, Calif. 90305

[21] Appl. No.: 810,897

[22] Filed: Jun. 28, 1977

[51] Int. Cl.[2] ..... A63F 9/00

[52] U.S. Cl. ..... 273/1 L; 273/95 R; 273/105 R

[58] Field of Search ..... 273/1 R, 1 E, 1 M, 1 L, 273/95 R, 105 R

[56] References Cited

U.S. PATENT DOCUMENTS

| | | | |
|---|---|---|---|
| 2,103,435 | 12/1937 | Pool | 273/95 R |
| 2,746,757 | 5/1956 | Frost | 273/1 L |
| 3,716,233 | 2/1973 | Kotwas et al. | 273/1 L |

*Primary Examiner*—Paul E. Shapiro

*Attorney, Agent, or Firm*—Julius Rubinstein

[57] ABSTRACT

A container filled with liquid is provided with a coin receiving opening at one end. An adjustably mounted coin receiving cup is mounted inside the container. When a coin is inserted in the coin receiving opening, it falls in random path toward the bottom of the container. The operator of the game adjusts the position of the cup, trying to catch the coin before it reaches the bottom of the container.

5 Claims, 3 Drawing Figures

COIN DROP GAME

BACKGROUND AND BRIEF SUMMARY

Games involving the coordination between the hand and the eye are well known and are generally popular. However, those games previously known were not always satisfactory when the game was to be played by handicapped or very young persons who may have some difficulty with their hand and eye coordination.

Handicapped persons undergoing therapy to increase hand and eye coordination have a particular need for this kind of apparatus or game, however it would be desireable to be able to slow down the action in accordance with the requirements or ability of the player.

What is needed therefore, and comprises an important object of this invention, is to provide an apparatus or game designed so the operator can catch a coin in a cup where the coin is falling slowly through a liquid.

A further object of this game is to provide a game wherein the operator catches a coin in a cup while the coin is falling slowly through a liquid, where the game is provided for means for adjusting the speed of the fall of the coin.

Another object of this invention is to provide an apparatus or game wherein the operator catches a coin in a cup while the coin is falling through the liquid wherethe game is provided with means for controlling the dispersion of the coins.

Other objects of this invention will become more apparent when better understood in the light of the specification and drawings wherein.

Figure 1:
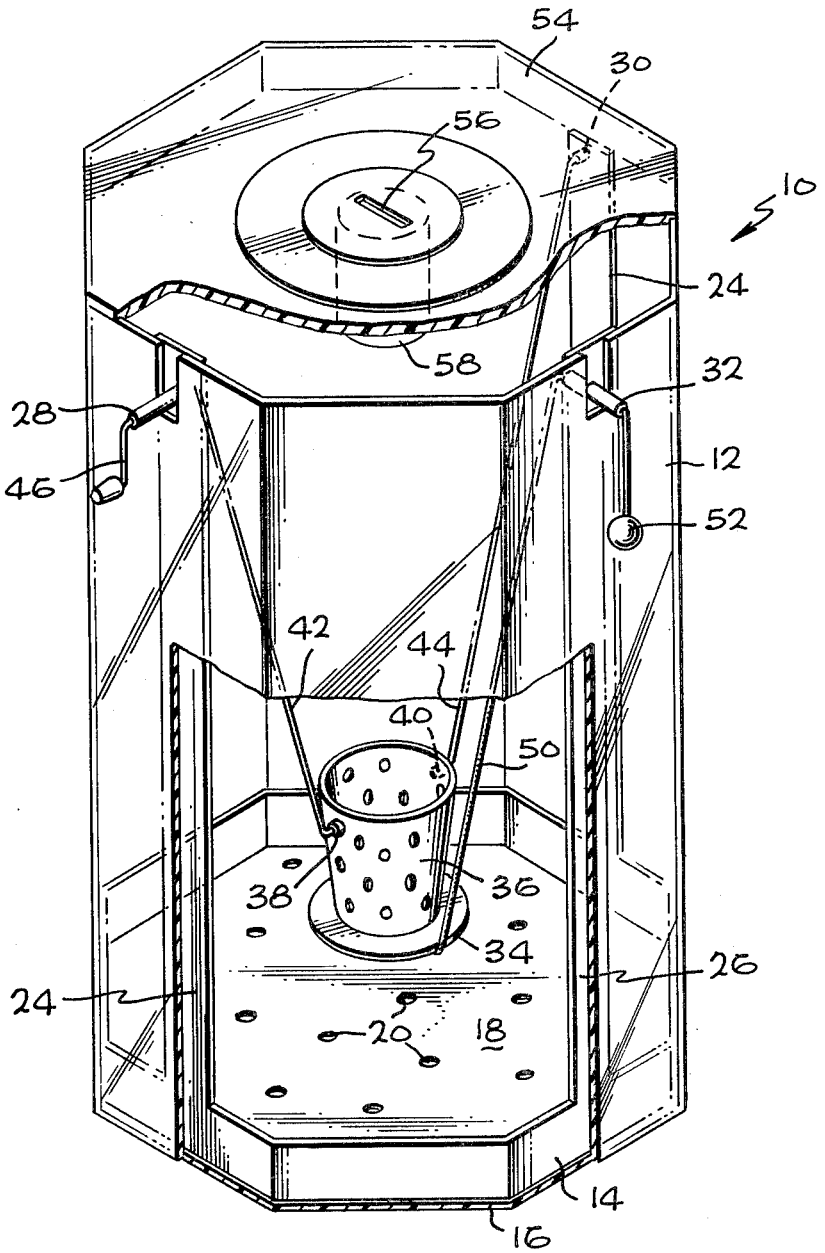
FIG. 1 is an elevational perspective view of the apparatus for playing the game.

Referring now to FIG. 1 of the drawings, the apparatus for the game, or training device, indicated generally by the reference numeral 10, comprises a container 12 which in the embodiment shown is octagonal in cross-section, although the number of sides is not critical, and in some circumstances a container cylindrical in cross-section might be used.

Figure 2:
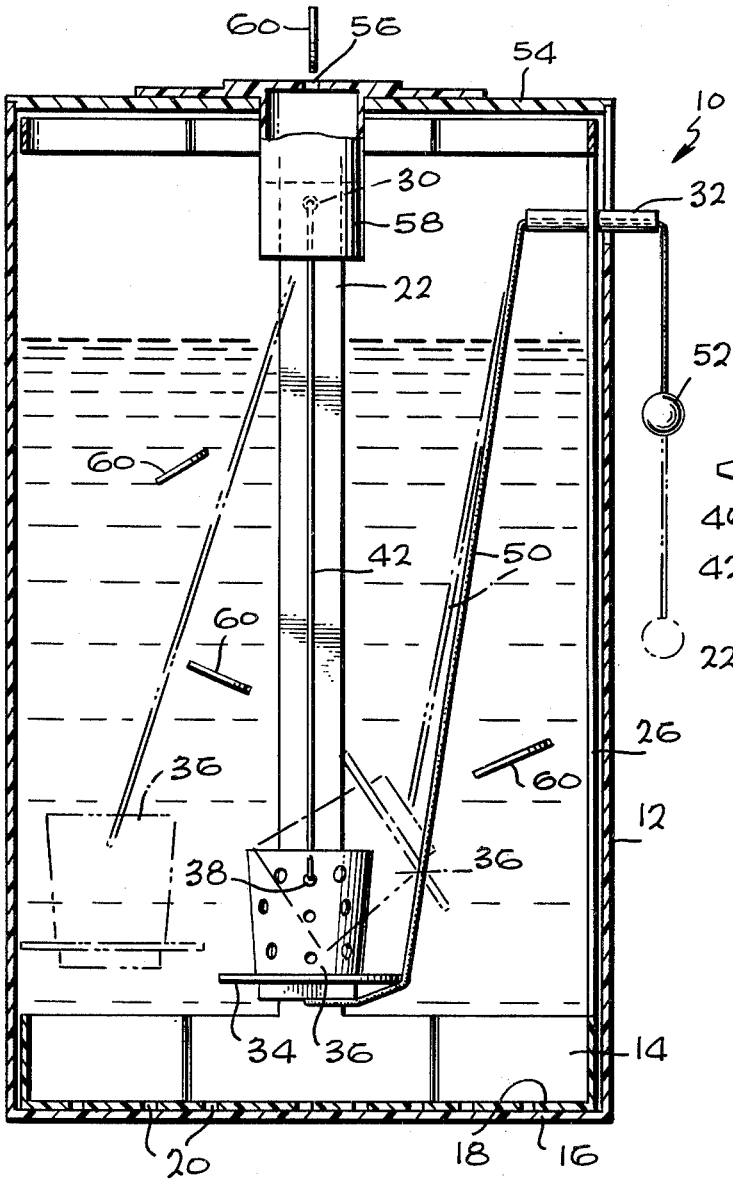
FIG. 2 is an elevational cross-sectional view of the apparatus shown in FIG. 1.

A basket 14 which in the embodiment shown is also octagonal in cross-section, although this is not critical, nests inside of the container on the bottom 16, see FIGS. 1 and 2. The base 18 of the basket is provided with perforations 20 for reasons to become apparent below, see FIG. 1.

Upstanding support bars 22, 24, and 26, are secured to opposite sides of the base 18 and in the case of support bar 26 in a plane perpendicular to the plane defined by support bars 22 and 24. These support bars extend upward into the container a distance slightly less than the length of the container 12. Horizontally disposed tubular bearings 28 and 30 and a cable guide 32 extend through the upper end of the support bars, see FIGS. 1, 2, and 3.

Figure 3:
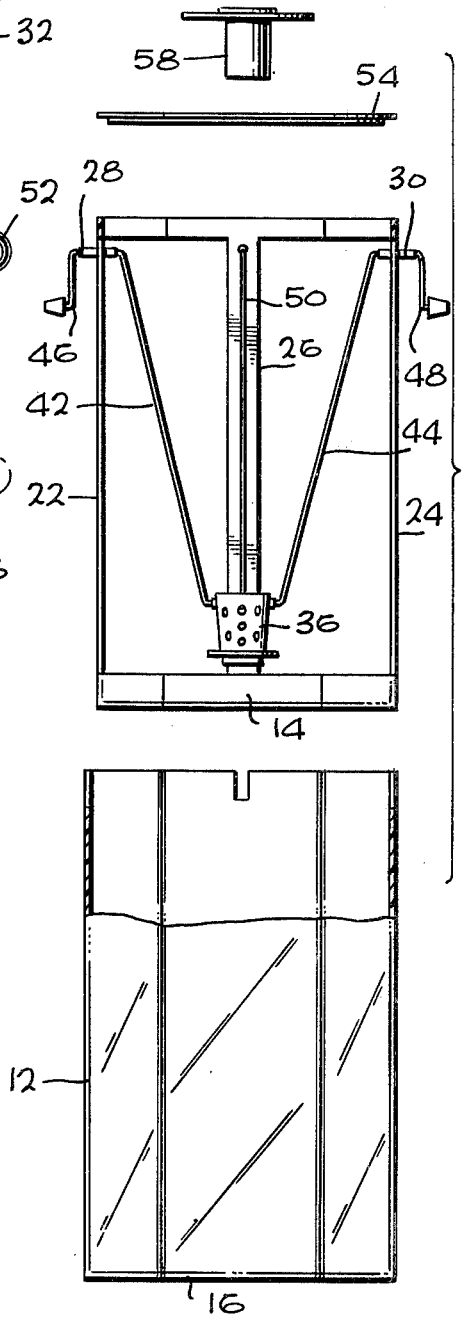
FIG. 3 is an elevational exploded view of the apparatus of the game.

A circular planar perforated platform 34 is provided. A perforated cup 36 is mounted on this platform. Bearing members 38 and 40 are mounted on diametrically opposite sides of the upper end of the cup, see FIG. 1. One end of stiff-wire supports 42 and 44 are pivotedly mounted in bearings 38 and 40 as shown. The stiff support wires are bent upwardly as shown in FIG. 1, and their opposed ends are bent so they extend through bearings 28 and 30. The extreme ends 46 and 48 of these support wires are bent as shown in FIGS. 1 and 3 to form a crank with handle members thereon.

To this point, it can be seen that by twisting the crank handles 46 and 48 the cup 36 can be made to swing on the supports 22 and 24 inside container 12, see FIGS. 1 and 2.

One end of a cable 50 is secured to the platform 34. The other end of the cable extends through the cable guide 32 and terminates in spherical knob 52. With this arrangement, by pulling the knob 52 the platform and cup pivot on bearings 38 and 40 so the cup can be made to turn upside down to spill the contents onto the base 18 of the basket 14.

A lid 54 is removeably mounted on the upper end of the container. The lid is provided with a coin receiving opening or slot 56. In the embodiment shown, a cylindrical "gun" barrel 58 is mounted on the lid beneath the coin receiving opening 56. The barrel extends downwardly inside the container. This barrel functions as a control element and restricts somewhat the dispersion of coins dropped through the coin receiving slot 56 for reasons to become apparent below. It is contemplated the barrel 58 could be available in different lengths 58, **58*a* or could be made to telescope, so its length can be easily changed for the purpose of controlling the dispersion of the coins falling through the coin receiving slot. This controls the difficulty of the game and the skill and coordination required. p In operation, the container 12 is filled with a suitable liquid such as water, or glycerine. A coin 60 is inserted in the coin receiving opening 56. The coin falls through the liquid more or less slowly, depending on the viscosity of the liquid 10, and it falls in a generally random path controlled somewhat by the length of the barrel 58. The operator of the game grasps the cranks 46 and 48 to swing the cup 36 back and forth trying to catch the coins. Success in the game is measured by the number of coins caught. After each player has completed his turn, the number of coins caught is recorded and the next player pulls the knob 52 until the cup turns upside down and spills the coins into the basket. After the available coins are exhausted, the lid is removed and the basket 14 is lifted from the container. While this is happening, the liquid in the basket drains through the perforations 20** permitting the coins in the basket to be recovered without difficulty. The speed of the game to the coordination required can be decreased by slowing the speed of fall of the coins falling through the container. This is accomplished by using a liquid with a suitable viscosity. In this way the game can be used as a training device to increase the hand-eye coordination of handicapped or very young persons.

Having described the invention, what I claim is new is:

1. A game of the class described comprising a container, said container having a coin receiving opening at one end, a coin receiving basket adjustably mounted inside the container, means connected to the coin receiving basket and controlled from outside the container for adjusting the position of the coin receiving basket in the container so that when a coin is inserted in the container the basket can be moved to catch the coin as it falls through the container, said container filled with liquid, the viscosity of the liquid selected to slow the movement of the coin falling through the container by a predetermined amount, said container including aiming means mounted at the upper end of the container to control the dispersion of coins dropped through the coin receiving opening.

2. An apparatus of the class described comprising a container, a perforated basket nested in the container, said basket having a base, two upstanding support members secured to the periphery of the base at opposite sides thereof and a third upstanding support member secured to the periphery of the base in a plane 90 degrees to the plane determined by the first two upstanding support members, a perforated cup, stiff-wire supports pivotally mounted to the opposite sides of the upper end of the cup, said stiff wire supports bent so they extend toward the upper end of the first two supports, said upper ends of the said first two supports having bearings extending therethrough, said stiff-wire supports bent so they extend through said bearings and out of the container, the extreme ends of the wire supports bent to form cranks whereby by twisting said cranks, the cup can be swung inside the container, means connected to the cup and controlled from outside the container for turning the cup upside down in the container whereby any coins caught in the cup can be spilled onto the basket, and a coin receiving opening at the upper end of the container so that when the coin is inserted in the coin receiving opening, the cup can be swung in an effort to catch the coin before it strikes the bottom of the basket.

3. The apparatus described in claim 2 wherein the container is filled with a liquid, the viscosity of the liquid selected to control the speed of the fall of the coin through the liquid.

4. The apparatus set forth in claim 3 including a cylindrical tube mounted below the coin receiving opening of the container, the length of the cylindrical barrel adjustable for controlling the dispersion of coins dropped from the coin receiving opening and passing through the cylindrical tube.

5. The apparatus set forth in claim 4 wherein a cable is secured to the bottom edge of the cup, a cable guide mounted in the upper end of the third upstanding support bar, the opposite end of the cable extending through the cable guide and terminating in a knob so that by pulling on the knob, the cup can be inverted to spill out the caught coins.

* * * * *